US008258904B2

(12) United States Patent
Ben-Asher et al.

(10) Patent No.: US 8,258,904 B2
(45) Date of Patent: Sep. 4, 2012

(54) MAGNETIC LATCHING SOLENOID AND METHOD OF OPTIMIZATION

(76) Inventors: Eldad Ben-Asher, Ramat HaSharon (IL); Micha Caro, Kibbutz Geva (IL)

( * ) Notice: Subject to any disclaimer, the term of this patent is extended or adjusted under 35 U.S.C. 154(b) by 211 days.

(21) Appl. No.: 12/793,554

(22) Filed: Jun. 3, 2010

(65) Prior Publication Data

US 2010/0315186 A1 Dec. 16, 2010

(51) Int. Cl.
*H01F 7/08* (2006.01)

(52) U.S. Cl. ..... 335/220; 251/129.01

(58) Field of Classification Search ..... 335/220–229, 335/253, 255; 251/129.01–129.22
See application file for complete search history.

(56) References Cited

U.S. PATENT DOCUMENTS 3,381,181 A * 4/1968 Weathers ..... 361/210
3,805,204 A 4/1974 Petersen
RE32,860 E * 2/1989 Clark ..... 335/261
5,066,980 A * 11/1991 Schweizer ..... 335/255
5,915,665 A 6/1999 Paese et al.
6,392,515 B1 5/2002 Van Zeeland et al.
6,489,870 B1 * 12/2002 Ward et al. ..... 335/220
6,698,713 B2 3/2004 Sato et al.
7,280,021 B2 10/2007 Nagasaki
2009/0072636 A1 3/2009 Gruden

* cited by examiner

*Primary Examiner* — Bernard Rojas
(74) *Attorney, Agent, or Firm* — Michael J. Donohue; Davis Wright Tremaine LLP

(57) ABSTRACT

A magnetic latching solenoid having a coil assembly, a ferromagnetic core slideably fitted to linearly translate upon excitation of the coil assembly by a pulse of electric current, a stationary electromagnetic pole positioned in line with the ferromagnetic core, at least one flux conductor and a frame, all forming a magnetic flux circuit. A contact area between a face of the ferromagnetic core and a face of the stationary electromagnetic pole is reduced by respective recesses in the ferromagnetic core and the electromagnetic pole, each recess having opposing inclined walls extending from the respective face to a common apex defining a depth of the recess, and forming a residual planar surface of concentrated flux density surrounding the recesses.

13 Claims, 3 Drawing Sheets

MAGNETIC LATCHING SOLENOID AND METHOD OF OPTIMIZATION

FIELD OF THE INVENTION

The present invention relates to magnetic latching solenoids, more particularly, to optimization of the armature contact area in a magnetic latching solenoid.

BACKGROUND OF THE INVENTION

A typical electromagnetic solenoid includes a wire coil wound round a stationary electromagnetic pole, and a movable ferromagnetic core (armature) which is separated by an air gap from the stationary electromagnetic pole. A surrounding soft iron frame forms, along with the stationary pole and the movable core, a magnetic circuit which is locally interrupted by the air gap. Upon excitation of the coil by an electric current, a magnetic flux is generated in the magnetic circuit. The magnetic flux results in the movable core being attracted to the stationary pole. The movable core, usually in the form of a plunger, is held in a retracted state until the coil is de-energized, whereupon it is then separated from the stationary pole by gravity if applicable, or by a biasing spring.

When the energized state must be maintained for an extended period of time and the energy source is limited, a magnetic latching solenoid is preferred. A magnetic latching solenoid uses residual magnetism or further includes a permanent magnet as part of the magnetic circuit and has extended and retracted natural states. In the extended state, the air gap is maximal and the magnetic flux generated by the permanent magnet or residual magnetism is too weak to pull the plunger against the biasing spring.

In order to throw to the retracted state (latch), a pulse of electric current is applied to the coil, generating an additional magnetic flux sufficient to stress the biasing spring and pull the plunger to the retracted state wherein the air gap is zero. In the retracted state, the flux density generated by the permanent magnet is sufficiently concentrated to latch the plunger against the stationary pole whilst stressing the biasing spring. The usable portion of the force applied by the permanent magnet in the retracted state is often called the holding force of the latching solenoid, while the pulling force generated by the electric pulse at the start of the stroke is named the attracting force.

In order to unlatch the solenoid, a reverse polarity pulse of electric current is to applied to the coil, sufficiently reducing (canceling) the holding force of the permanent magnet such that the biasing spring can force the plunger away from the stationary pole.

In applications where space is limited, it may be desirable that the solenoid be exactly matched to its duty in terms of force and electric power. In such cases it is important to find the minimal size of permanent magnet and coil that will provide the required holding and attracting forces respectively.

The attracting and holding force of a solenoid in simple terms is approximately defined by the equation:

$$F=AB^2/2\mu_0$$

where: F is the force obtained,

A is the cross sectional area of the plunger,

B is the flux density generated at the plunger face, and $\mu_0$ is the permeability of free space.

However, the flux density B, cannot be increased indefinitely as the core material enters into saturation at a certain flux density level related to the core material. The flux density B depends also on the air gap or stroke of the solenoid. As a general rule, the attraction force of a magnet is inverse to the square of the gap.

Accordingly in the search for maximal attraction and holding forces, the flux density B must be close to saturation and the cross-sectional area A, reduced to the point where that desired flux density is obtained. Reduction of the cross-sectional area at the entire length of the plunger and stationary pole is not recommended since the reluctance of the magnetic circuit increases. Thus it is known in the art to provide a conical or stepped-conical saturation tip to the plunger in order to maximize the force of attraction of long stroke solenoids. Short stroke solenoids, however, are typically known to act better with a flat plunger face.

References to such prior art can be found in U.S. Pat. Nos. 6,698,713; 7,280,021; 6,392,515; 5,915,665; 3,805,204 and U.S. Application 2009/0072636.

Although latching solenoids are operated by a DC pulse, the short duration of the excitation pulse is equivalent in behavior to an AC current. Accordingly, an additional consideration factor is involved, similar to the known characteristics of a ferromagnetic core which is energized by high frequency AC current. It has been found that in such applications, the magnetic field produced by the eddy current and displacement current due to the electrical field will shield the magnetic flux from the inner portion of the core cross-section. This results in a flux skin effect analogous to the skin effect in the conductors of a wound coil. Simply stated, the flux density during excitation of the coil is higher at the circumference of the plunger face than at the inner surface.

A disadvantage of the suggested conical saturation tip for long stroke solenoids or the flat face for short stroke magnetic latching solenoids is related to the skin effect that directs the majority of the flux lines to the exterior of the plunger volume, thus resulting in early saturation of the effective surface area and loss of mechanical power.

Additionally in short stroke magnetic latching solenoids with a flat plunger face the desired stroke may not be sufficiently large and the permanent magnet may retract the plunger back after the reverse polarity pulse of electric current is applied to the coil.

Consequently a new approach is required to further improve the efficiency of magnetic latching solenoids, particularly of short stroke magnetic latching solenoids.

SUMMARY OF THE INVENTION

It is thus one object of the present invention to provide an improved magnetic latching solenoid.

It is another object of the present invention to provide a method of optimizing a magnetic latching solenoid.

These objectives are achieved according to one embodiment of the present invention, by a magnetic latching solenoid comprising:

a coil assembly, a ferromagnetic core slideably fitted to linearly translate upon excitation of the coil assembly by a pulse of electric current, a stationary electro-magnetic pole positioned in line with the ferromagnetic core, at least one flux conductor and a frame, all forming a magnetic flux circuit;

wherein a contact area between a face of the ferromagnetic core and a face of the stationary electromagnetic pole is reduced by respective recesses in the ferromagnetic core and the electromagnetic pole, each of said recesses having opposing inclined walls extending from the respective face to a common apex defining a depth of the recess, and forming a residual planar surface of concentrated flux density surrounding said recesses.

The method of optimizing such a solenoid includes:

maximizing the holding force by reducing the contact face area of the ferromagnetic core and the stationary electromagnetic pole via increasing said centric inclined wall recess to the point where the magnetic flux density, in the mating faces, induced by said permanent magnet in the retracted state, is near saturation such that the value of the term $AB^2$ (A=contact face area, B=flux density) reaches its maximal available value;

defining a stroke sufficiently large to prevent retraction of the solenoid by said permanent magnet alone;

maximizing the attracting force by specifying a coil that, during an excitation pulse, restores the value of the flux density in the extended state to the same near saturation level as provided by the permanent magnet in the retracted state.

BRIEF DESCRIPTION OF THE DRAWINGS

In order to understand the invention and to see how it may be carried out in practice, embodiments will now be described, by way of non-limiting example only, with reference to the accompanying drawing, in which.

DETAILED DESCRIPTION OF EMBODIMENTS

Figure 1:
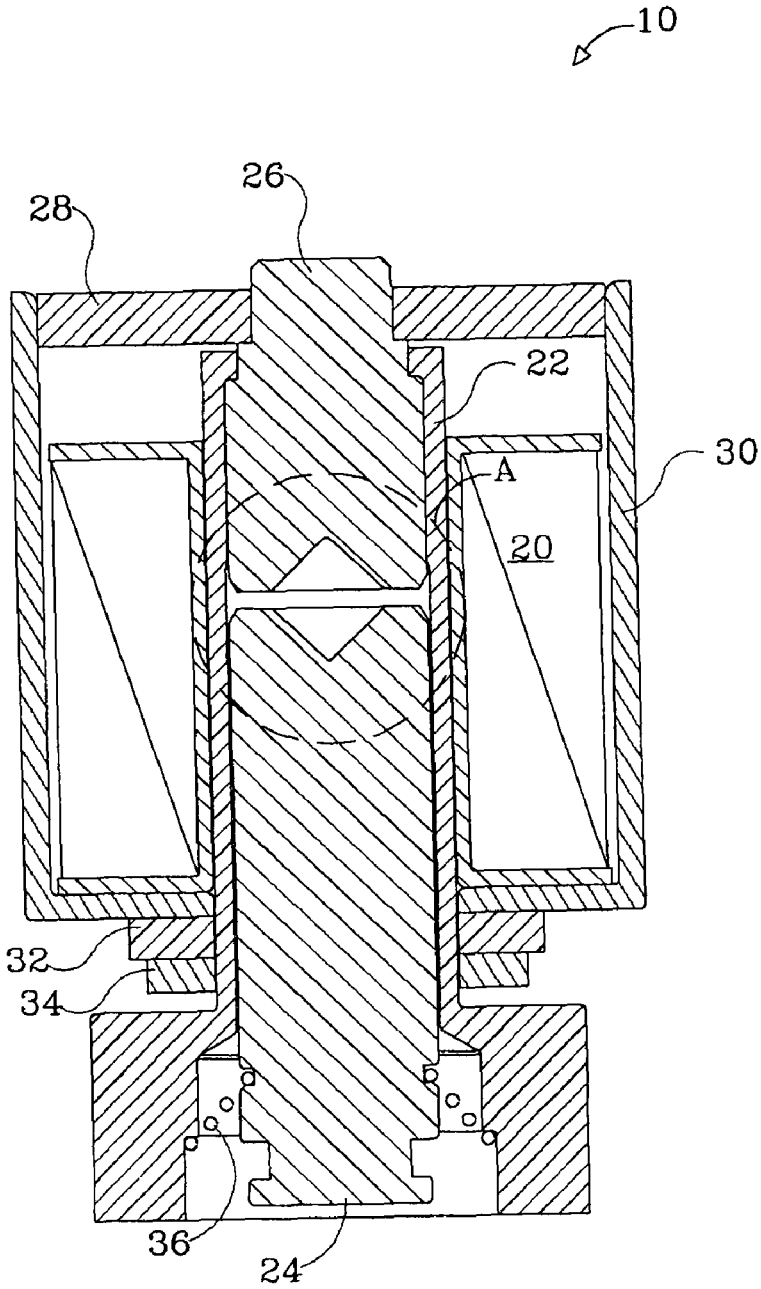
FIG. 1 is a schematic sectional view of a latching solenoid modified according to an embodiment of the present invention.

With reference to FIG. 1, there is shown a magnetic latching solenoid generally referenced 10, comprising a coil assembly 20 wound round a non-ferromagnetic tube 22. A ferromagnetic core in the form of a cylindrical plunger 24 is slideably fitted to linearly translate in the tube 22 upon excitation of the coil assembly 20 by a pulse of electric current. A cylindrical stationary electromagnetic pole 26, positioned in line with the plunger 24, along with flux conductor 28 and frame 30 form together with the plunger 24 a magnetic flux circuit.

A washer type permanent magnet 32 attached under the frame 30 by a ferm-magnetic retaining ring 34 induces a constant magnetic flux in the magnetic circuit. The size of the permanent magnet 32 is determined such that the magnetic flux in the electromagnetic pole 26 and the plunger 24 is sufficient to induce stress in a spring 36, and obtain the required holding force of the solenoid 10, upon cessation of the pulse of power delivered to the coil assembly 20. The spring 36 may be a tension or compression spring that is therefore either pulled or compressed upon application of a pulse of electric current to the coil. The retention of the plunger 24 may be released by application of a reverse polarized pulse of current to the coil assembly 20.

In order to minimize the size of the selected permanent magnet, the contact face area of the plunger 24 and the electromagnetic pole 26 is reduced to the point where the magnetic flux density in the mating faces is near saturation such that the value of the term $AB^2$ (A=contact face area, B=flux density) reaches its maximal available value.

Figure 2:
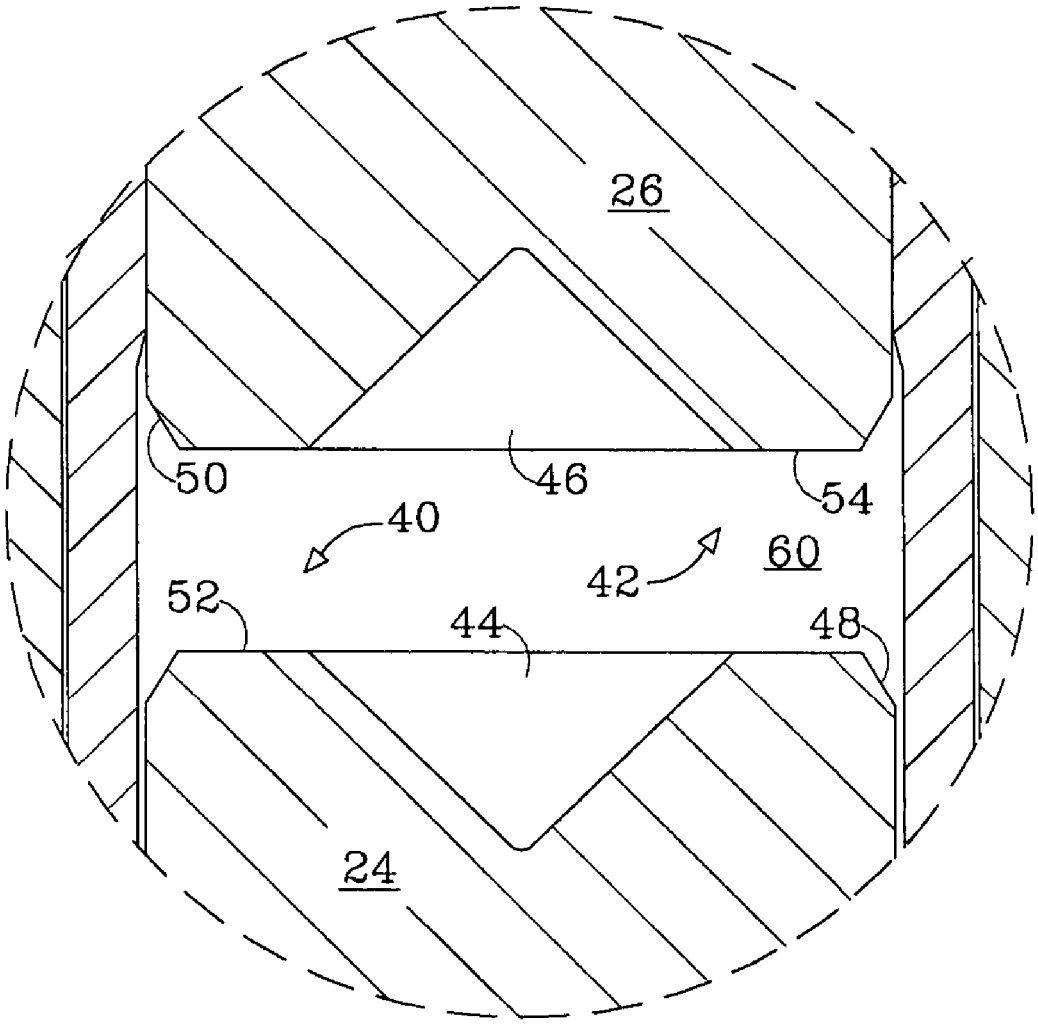
FIG. 2 is an enlargement of the circled area marked A in FIG. 1.
Figure 3:
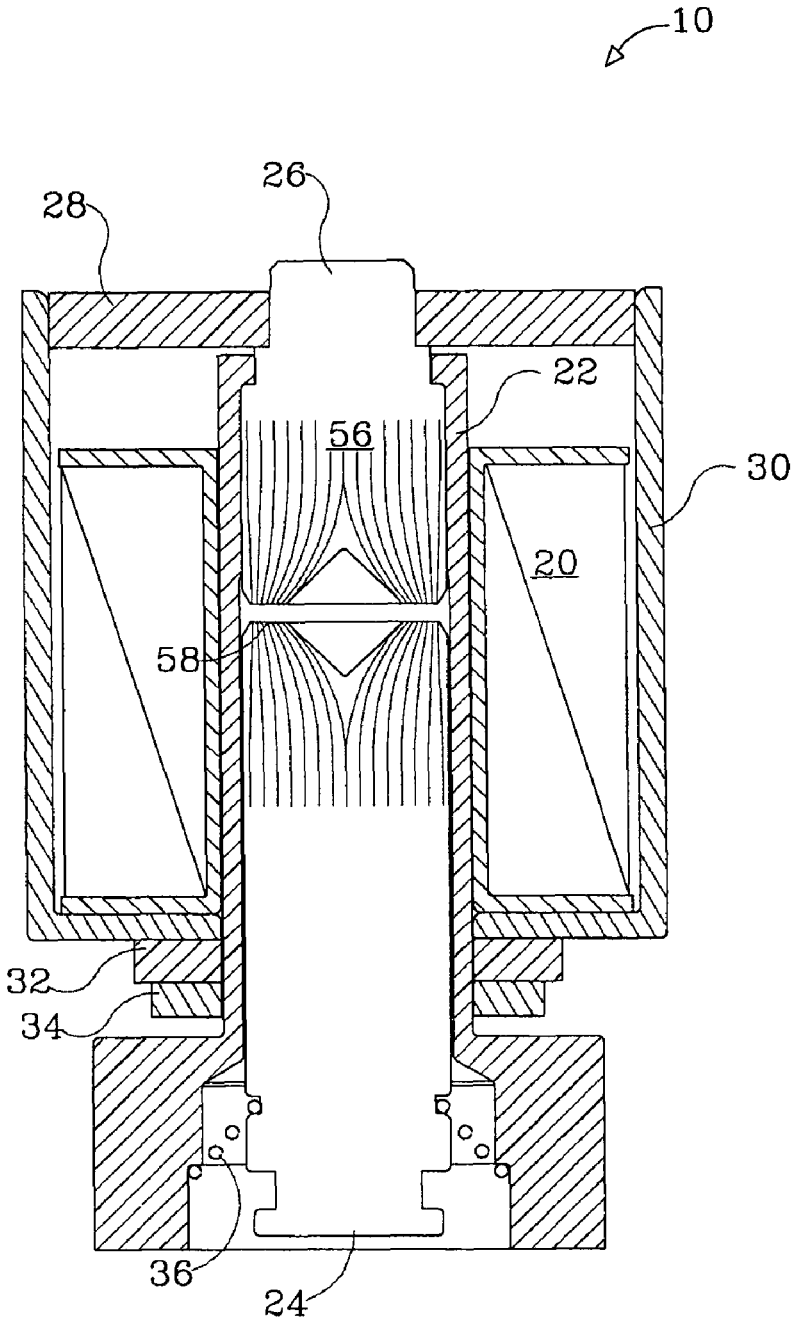
FIG. 3 is a schematic sectional view as in FIG. 1, shown with magnetic flux lines.

However in contrast to the known conical saturation tip, here with reference to FIG. 2, the contact area of the plunger face 40 and the stationary pole face 42 is reduced by a respective conical recess 44, 46 that is preferably disposed centrally with respect to the respective face, and a relatively small circumferential chamfer 48, 50, leaving flat tubular contact face areas 52, 54, of concentrated flux density at a near saturation value surrounding the conical recesses 44, 46. In the embodiment shown in the figures, each of the recesses 44, 46 has opposing inclined walls extending from the respective face 40, 42 to a common apex defining a depth of the recess, thus forming a residual planar surface of reduced surface area surrounding the recesses having concentrated flux density. The flux lines 56 and the short near saturation zone 58 are schematically shown in FIG. 3. The conical recesses 44, 46, direct the flux lines 56 in a smooth transition to the tubular faces 52, 54, preventing loss of flux or early saturation as would occur if cylindrical recesses or external conical saturation tip were used.

Optimizing the proposed solenoid is performed by maximizing the holding force by reducing the contact face area 52, 54 of the plunger and the stationary electromagnetic pole respectively via increasing the conical recess 44, 46, to the point where the magnetic flux density, in the mating faces 52, 54, induced by the permanent magnet 32 in the retracted state, is near saturation. This is followed by defining a stroke sufficiently large to prevent retraction of the solenoid 10 by the permanent magnet 32 alone. Following the determination of the face area associated with the permanent magnet while in the retracted state, the size of the coil can thus be specified. In the extended state, the air gap 60 (FIG. 1) is maximal and the flux density provided by the permanent magnet 32 is considerably reduced. The reduced contact face area 52, 54 also contributes to prevent re-retraction of the plunger by the permanent magnet alone whilst in the extended state. Optimally, during the excitation pulse, the coil assembly 20 should restore the value of the flux density to the same near saturation level as provided by the permanent magnet 32 in the retracted state, thus making use of the same areas 52, 54 to provide the maximal available attracting force.

Additionally, due to the skin effect described above, the reduction of the central contact area by the conical recesses 44, 46, have little influence on total flux density as most flux lines are directed to the outer volume of the plunger, permitting more efficient usage of the electric power.

It has been experimentally shown by the applicant that performance of the solenoid using the suggested technique is greatly improved with varying degree depending on the length of stroke and type of application. The angle of the conical recesses 44, 46, is determined according to the specific application requirements.

It will be evident to those skilled in the art that the invention is not limited to the details of the foregoing illustrated embodiments and that the present invention may be embodied in other specific forms without departing from the essential attributes thereof. The description is therefore to be considered in all respects as illustrative and not restrictive, the scope of the invention being indicated by the appended claims rather than by the foregoing description, and all changes which come within the meaning and range of equivalency of the claims are therefore intended to be embraced therein.

Thus, while the invention has been described with reference to a tubular plunger and a tubular stationary pole provided with central conical recess, it will be understood that other external contours such as square, rectangular, triangular or any polygonal or elliptical shape, furnished with central inclined-wall recess deep to the point where the inclined walls are meeting, preferably following the external contour, all of which fall within the scope of the present invention and claims.

The invention claimed is:

1. A magnetic latching solenoid comprising:

a coil assembly, a ferromagnetic core slideably fitted to linearly translate upon excitation of the coil assembly by a pulse of electric current, a stationary electromagnetic pole positioned in line with the ferromagnetic core, at least one flux conductor and a frame, all forming a magnetic flux circuit;

wherein a contact area between a face of the ferromagnetic core and a face of the stationary electromagnetic pole is reduced by a respective recess in both the ferromagnetic core and the electromagnetic pole, each of said recesses having opposing inclined walls extending inwardly from the respective face of the ferromagnetic core and the electromagnetic pole to a respective common apex in the ferromagnetic core and the electromagnetic pole defining a depth of the respective recess, and forming a respective residual planar annular surface of concentrated flux density surrounding said recesses.

2. The magnetic latching solenoid as claimed in claim 1, wherein a permanent magnet is attached to the frame for inducing a constant magnetic flux in the magnetic circuit.

3. The magnetic latching solenoid as claimed in claim 2, wherein said permanent magnet is a washer type permanent magnet.

4. The magnetic latching solenoid as claimed in claim 2, wherein the depth of each of said recesses is such that the magnetic flux density, in the mating faces induced by the permanent magnet in the retracted state, is near saturation.

5. The magnetic latching solenoid as claimed in claim 4, wherein each of the recesses is conical in shape.

6. The magnetic latching solenoid as claimed in claim 1, wherein said inclined-wall recess is central in relation to the face of said ferromagnetic core and stationary electromagnetic pole.

7. The magnetic latching solenoid as claimed in claim 1, wherein the contact area of the ferromagnetic core face and the stationary electromagnetic pole face is further reduced by a circumferential chamfer, small in relation to said recess.

8. The magnetic latching solenoid as claimed in claim 1, wherein said ferromagnetic core is a cylindrical plunger.

9. The magnetic latching solenoid as claimed in claim 8, wherein said plunger linearly translates in a non ferromagnetic tube.

10. The magnetic latching solenoid as claimed in claim 1, wherein the face of said stationary electromagnetic pole and the face of the ferromagnetic core have identical cross-sectional areas.

11. The magnetic latching solenoid as claimed in claim 1, wherein said inclined-wall recess is conical in shape.

12. A method for optimization of a magnetic latching solenoid having a coil assembly, a ferromagnetic core slideably fitted to linearly translate upon excitation of the coil assembly by a pulse of electric current, a stationary electromagnetic pole positioned in line with the ferromagnetic core, at least one flux conductor and a frame, all forming a magnetic flux circuit; the method comprising:

maximizing a holding force by reducing a contact area between a face of the ferromagnetic core and a face of the stationary electromagnetic pole by forming respective recesses in each of the ferromagnetic core and the electromagnetic pole, each of said recesses having opposing inclined walls extending inwardly from the respective face to a respective common apex in the ferromagnetic core and the electromagnetic pole defining a depth of the respective recess and forming a respective residual planar annular surface of concentrated flux density surrounding said recesses; and increasing the depth of said recesses so that the magnetic flux density, in the mating faces, induced by said permanent magnet in the retracted state, is near saturation such that the value of the term $AB^2$ (A=contact face area, B=flux density) reaches its maximal available value.

13. The method according to claim 12, further including:

attaching a permanent magnet to the frame for inducing a constant magnetic flux in the magnetic circuit;

defining a stroke sufficiently large to prevent retraction of the solenoid by said permanent magnet alone;

maximizing the attracting force by providing a coil so configured that, during an excitation pulse, flux density in the extended state is restored to its magnitude at near saturation level as provided by the permanent magnet in the retracted state.

* * * * *